US011034423B2

(12) United States Patent
Pelland et al.

(10) Patent No.: US 11,034,423 B2
(45) Date of Patent: Jun. 15, 2021

(54) PEDAL DRIVE SYSTEM FOR WATERCRAFT

(71) Applicants: Marc Pelland, Brossard (CA); Steven Horvath, Uxbridge (CA)

(72) Inventors: Marc Pelland, Brossard (CA); Steven Horvath, Uxbridge (CA)

( * ) Notice: Subject to any disclaimer, the term of this patent is extended or adjusted under 35 U.S.C. 154(b) by 0 days.

(21) Appl. No.: 16/231,985

(22) Filed: Dec. 25, 2018

(65) Prior Publication Data

US 2019/0263494 A1 Aug. 29, 2019

Related U.S. Application Data

(60) Provisional application No. 62/710,698, filed on Feb. 26, 2018.

(51) Int. Cl.
*B63H 16/20* (2006.01)

(52) U.S. Cl.
CPC ..... *B63H 16/20* (2013.01); *B63H 2016/202* (2013.01)

(58) Field of Classification Search
CPC ..... B63H 16/20; B63H 2016/202
See application file for complete search history.

(56) References Cited

U.S. PATENT DOCUMENTS 1,701,381 A * 2/1929 Marangoni ..... B63H 16/14 440/30
3,915,110 A * 10/1975 Benwell ..... B63H 16/14 440/30
5,145,424 A * 9/1992 Han ..... B63H 16/08 105/88
5,362,264 A * 11/1994 Parant ..... B63B 32/56 440/29
5,368,507 A * 11/1994 Harris ..... B63H 1/34 440/29
5,702,274 A * 12/1997 White ..... B63H 16/14 114/61.22
6,135,835 A * 10/2000 Lekhtman ..... B63B 34/00 441/31
6,165,030 A * 12/2000 Lewis ..... B63H 16/14 440/30
6,712,653 B2 * 3/2004 Free ..... B63H 16/14 440/27
9,365,272 B1 * 6/2016 Foglia ..... B63B 32/00
9,533,746 B1 * 1/2017 Garrett ..... B63H 1/16
2019/0263494 A1 * 8/2019 Pelland ..... B63H 16/20

* cited by examiner

*Primary Examiner* — S. Joseph Morano
*Assistant Examiner* — Jovon E Hayes

(57) ABSTRACT

Disclosed is a pedal drive system for use with a watercraft that facilitates propelling of the watercraft. The pedal drive system of the present invention is placed through an opening in the bottom of the watercraft and affixed to the body of the watercraft. The propeller is then attached to a drive shaft. The user provides mechanical input (e.g., rotational force) by rotating pedals of a pedal arrangement of the pedal drive system. The rotational force is transferred from the drive assembly through the gears to the drive shafts that rotates the propeller, thus driving the watercraft forward as well as backward.

17 Claims, 7 Drawing Sheets

PEDAL DRIVE SYSTEM FOR WATERCRAFT

CROSS-REFERENCE TO RELATED PATENT DOCUMENTS

This patent application claims the benefit of priority of U.S. Provisional Application No. 62/710,698, entitled "Pedal Drive System for Watercraft," filed Feb. 26, 2018, which are hereby incorporated herein by reference in its entirety.

FIELD OF THE INVENTION

The present invention relates generally to watercrafts such as kayaks, canoes, paddle boards, or the like, and, more particularly, to a pedal drive system for a watercraft for propelling the watercraft based on mechanical input provided by a user by means of a pedal arrangement.

BACKGROUND

Various types of boats have been known and used by users since long time. Most of these boats have used sailing or some other artificial form of propulsion. Human-powered boats have also been known for thousands of years, and have generally used oars. Human-powered watercrafts are used on a large scale in coastal areas, and also are often used for exercise. The exercise results from the user employing his or her physical strength to provide motive power for the watercraft. Human-powered watercrafts are used for transportation, fishing, watersports activities, or the like. Examples of the human-powered watercrafts include, but are not limited to, kayaks, rowboats, and pedal boats. These all carry additional benefits, in that they provide the user with physical exercise.

Various drive systems are known in the art for providing motive power to a watercraft, such as a kayak or a canoe. In some examples, a pedal-powered drive system is provided as an alternative to a watercraft with a gas-powered drive system or an oar-powered drive system. An advantage of pedal-powered drive systems over gas-powered drive system is the pedal-powered drive systems are silent and more environmentally friendly than a gas-powered drive system. In addition, the watercraft with the pedal-powered drive systems can be taken into water with rock hazards without the fear of destroying the propeller, such as with a gas-powered motor. Compared to the oar-powered drive systems, the pedal-powered drive systems allow the user to use his or her legs to power the watercraft, which provides a mechanical advantage that allows for reaching greater speeds in water compared to using an arm-powered oar.

While the existing pedal-powered drive systems provide a number of advantages, they are also associated with a number of disadvantages. For example, various materials of a pedal drive system are not corrosion proof and degrade when they are exposed to water. Thus, the pedal drive system requires a lot of maintenance that increases the overall operating cost. Furthermore, in order to reduce the corrosion effect, the current pedal drive systems have been designed to keep water out of the mechanism in an attempt to increase drive assembly longevity. This dramatically increases the design and manufacture costs as sealing the unit becomes a primary consideration. Water ingress in these units typically leads to drive component failure through oxidation or mechanical degradation of internal components. Also, in a traditional attachment, the transfer of power from a metal drive shaft to a plastic gear would require a much larger gear assembly to resist failure. In light of the foregoing, there exists a need for a technical and more reliable solution that solves the above-mentioned problems and provides an improved pedal-powered drive system for watercraft that overcomes the disadvantages of the existing drive systems.

BRIEF SUMMARY

It is an objective of the present invention to provide a pedal drive system for a watercraft for propelling the watercraft based on mechanical input provided by a user by means of a pedal arrangement. The present invention provides the pedal drive system that transfers rotational motion from a user to a propeller of the watercraft. The propeller is disposed beneath the watercraft such as a kayak or a canoe. The pedal drive system includes an enclosure that houses a pedal mechanism. In an embodiment, the pedal mechanism incorporates a channel around the circumference of a wheel that rotates when a user operates pedals of the pedal arrangement. The channel retains a first gear that extends below the pedal mechanism where it first makes contact with a second gear. The second gear is positioned in manner in which the second gear is perpendicular to the first gear (90 degrees) and rotates from the motion imparted to it by the first gear.

In an embodiment, the second gear is attached to a drive shaft that extends vertically below the hull of the watercraft, and shares an axis of rotation with the second gear. The opposing end of the drive shaft retains a third gear that also shares an axis of rotation with the drive shaft and the second gear. The third gear drives a fourth gear positioned perpendicularly so that the axis of the fourth gear is parallel to the long axis of the watercraft such that the axis is oriented towards the stern of the watercraft. The fourth gear drives a second shaft which translates the drive motion to the propeller of the watercraft.

In an embodiment, a protective body, such as the one illustrated in the shape of a fin, is placed in front of the propeller to protect the propeller from any damage while in the water. In an embodiment, a pair of foot pegs are provided for the user to rest his or her feet when the user is not pedaling. While the drive shaft has been described in the preferred embodiment, a roller chain or band can also be used in other embodiments, without limiting the scope of the present invention.

Further, in an embodiment, the pedal drive system of the present invention is placed through an opening in the bottom of the watercraft and affixed to the body of the watercraft. The propeller is then attached to the drive shaft. When the user operates the pedal mechanism, the rotational force is transferred from the drive assembly through the gears to the drive shafts that rotates the propeller, thus driving the watercraft forward as well as backward.

These and other features and advantages along with other embodiments of the present invention will become apparent from the detailed description below, in light of the accompanying drawings.

BRIEF DESCRIPTION OF THE ACCOMPANYING DRAWINGS

The novel features which are believed to be characteristic of the present disclosure, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this disclosure will now be described by way of example in association with the accompanying drawings in which:

Figure 7A:
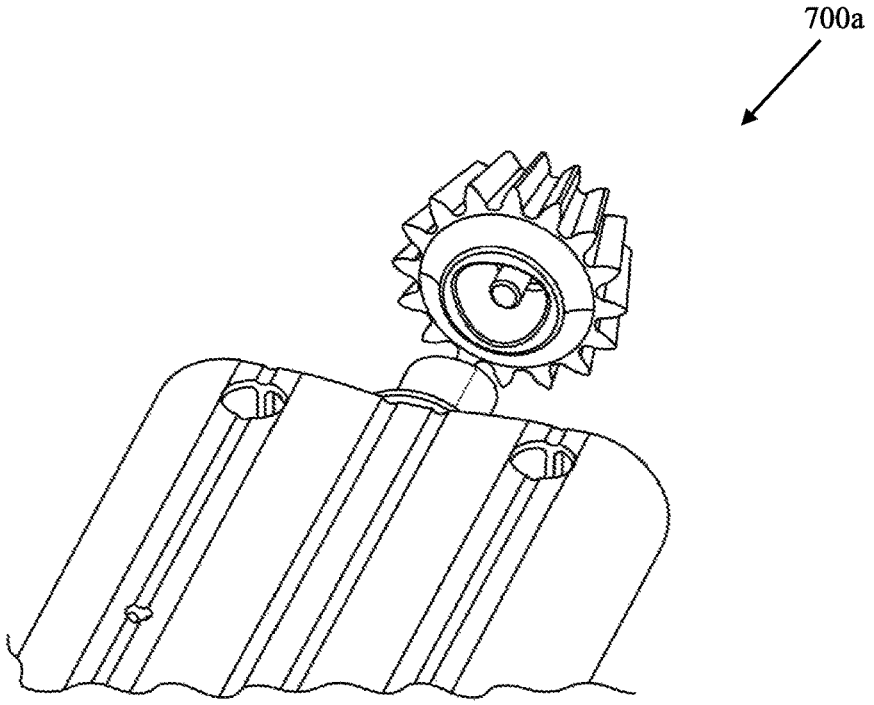
Figure 7B:
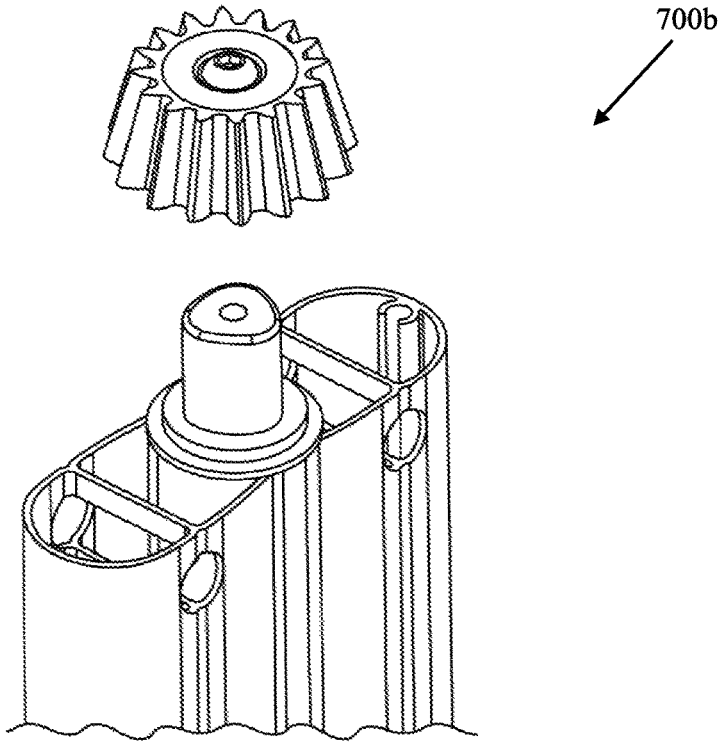
Figure 8A:
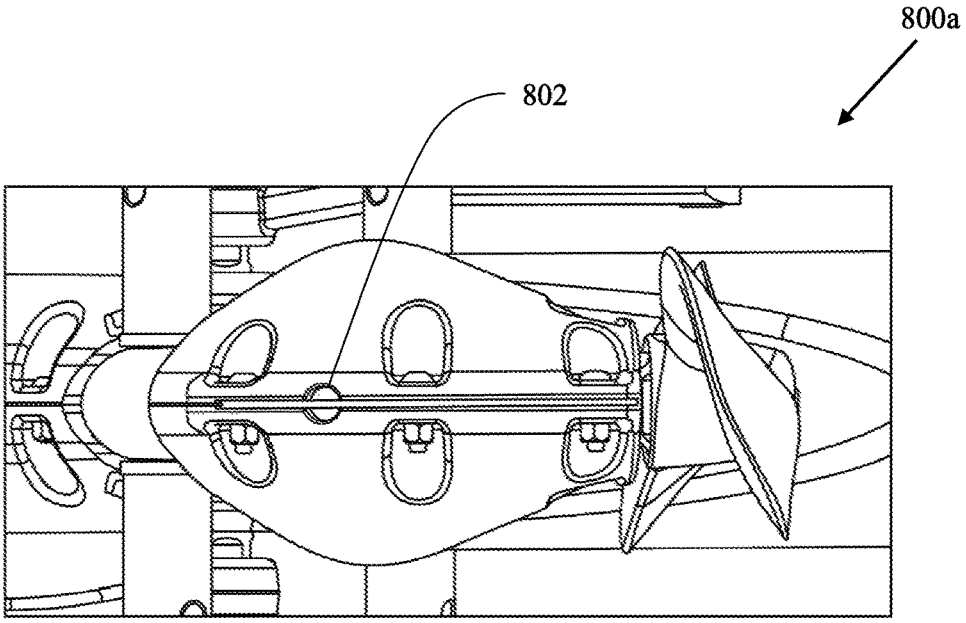
Figure 8B:
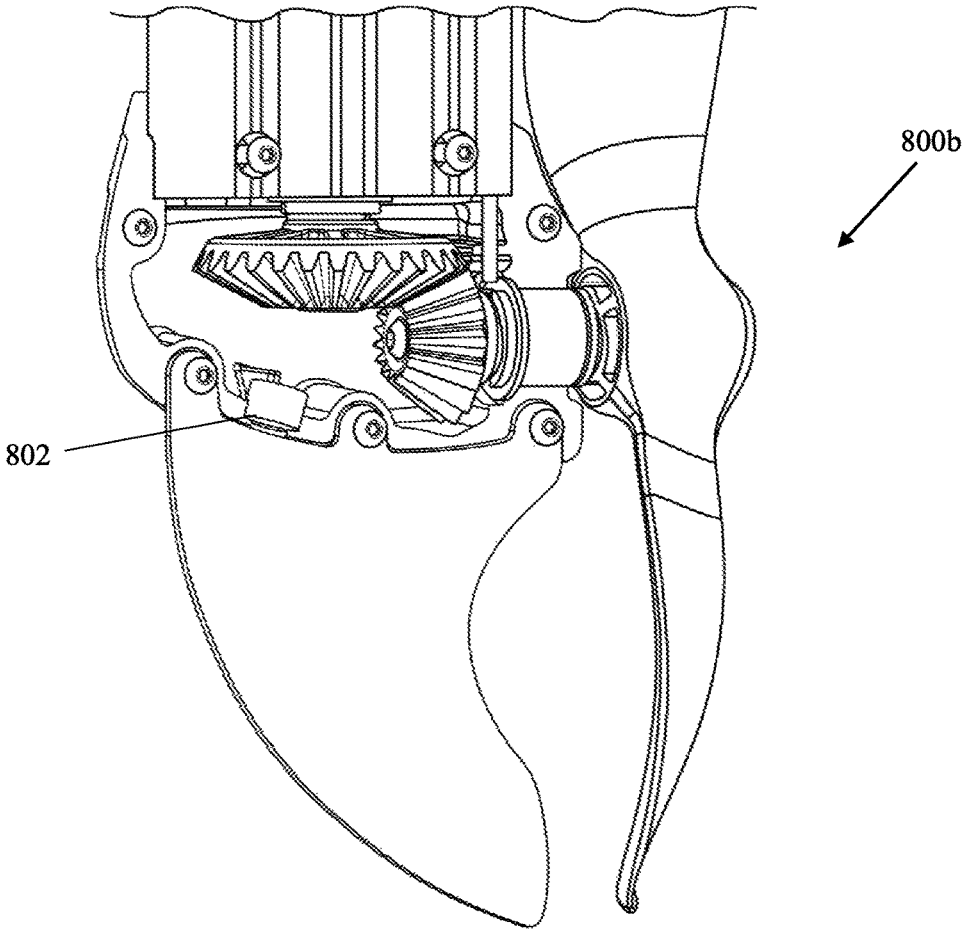
Figure 9A:
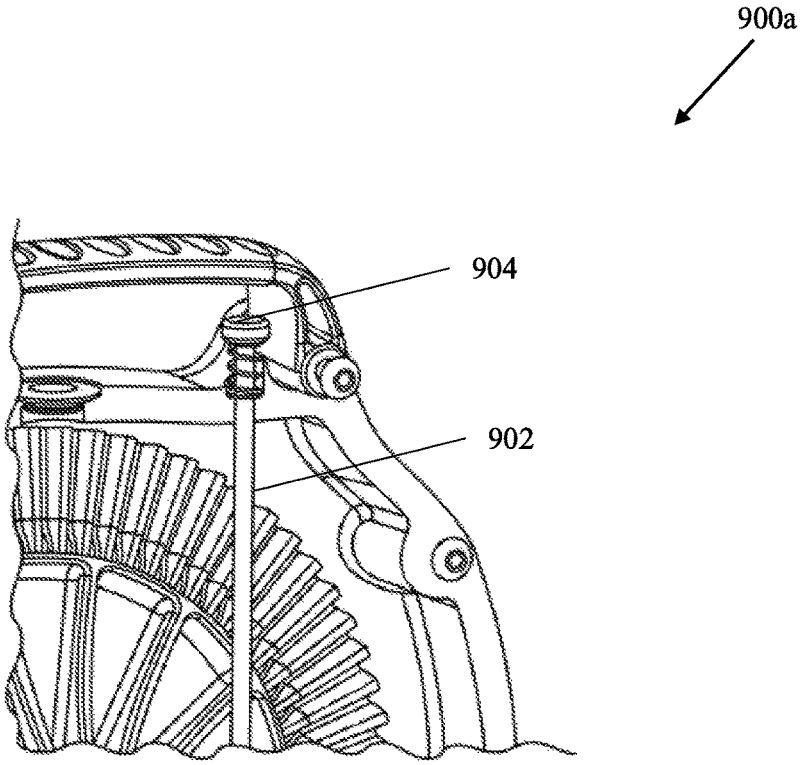
Figure 9B:
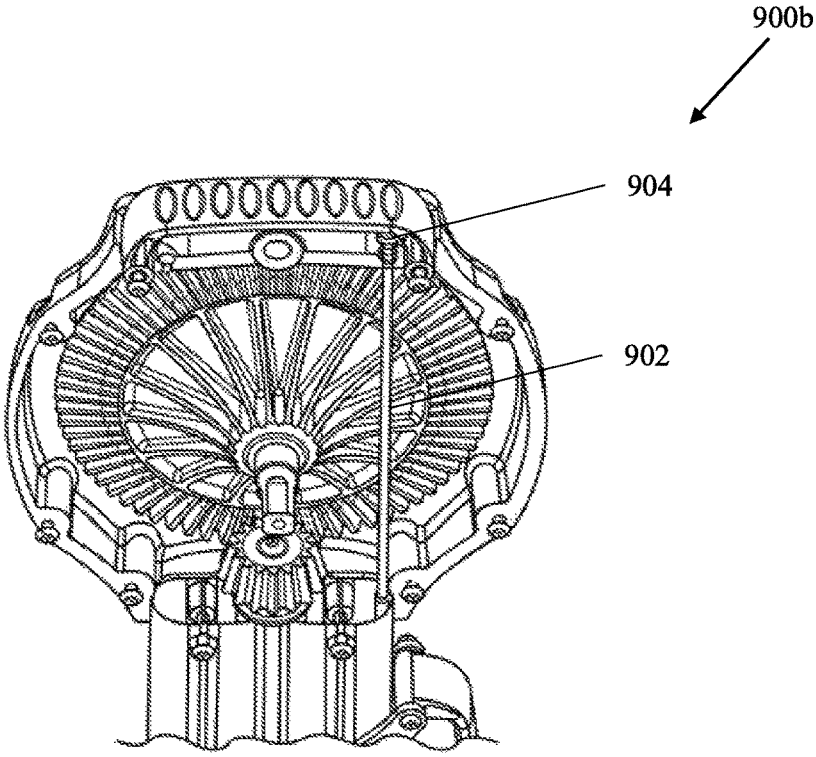
Figure 9C:
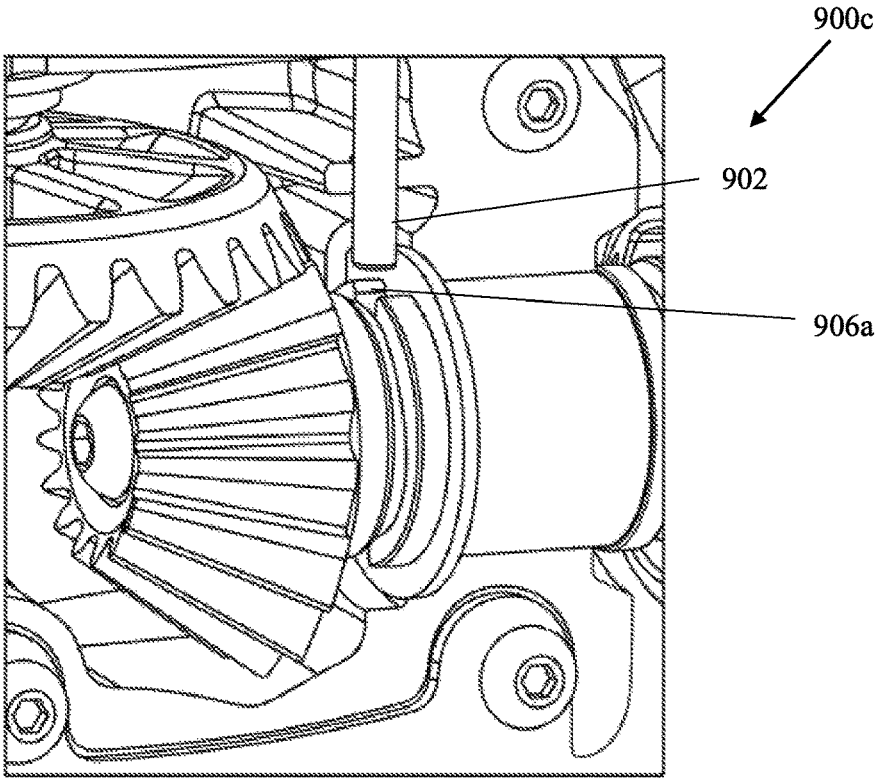
Figure 9D:
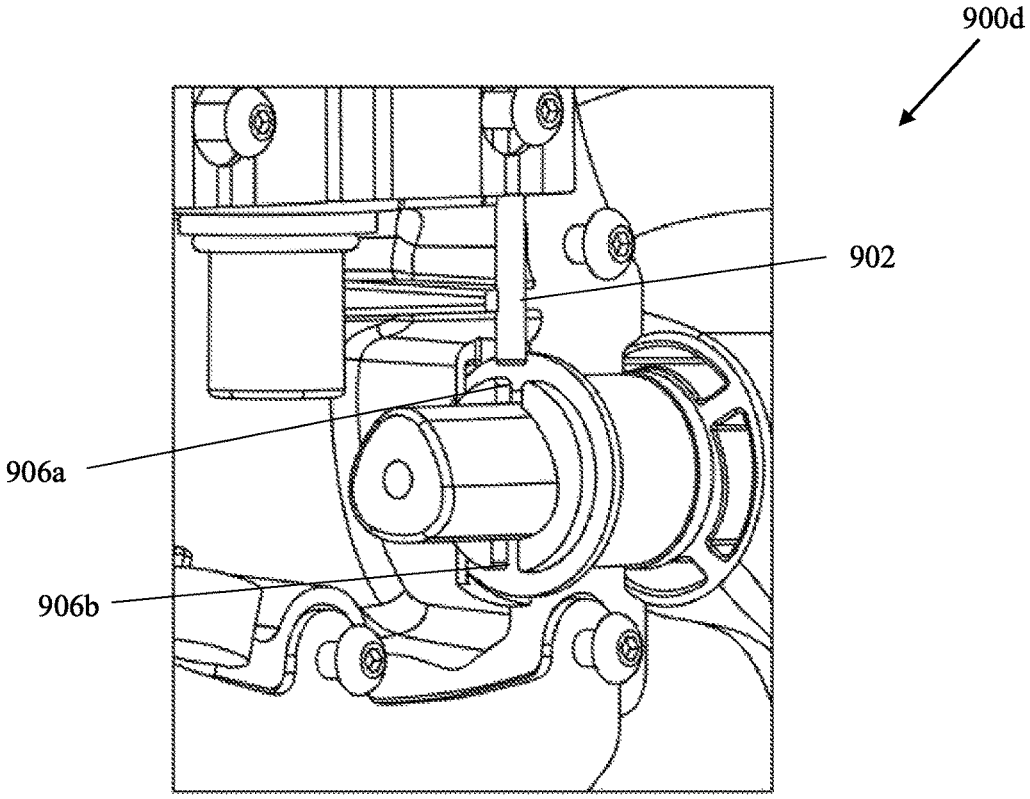

FIG. 7*a* shows a schematic arrangement that illustrates a bottom perspective view of the gear and the tri-lobe drive shaft, in accordance with an embodiment of the present invention;

FIG. 7*b* shows a schematic arrangement that illustrates a top perspective view of the gear and the tri-lobe drive shaft, in accordance with an embodiment of the present invention;

FIG. 8*a* shows a schematic arrangement that illustrates an enclosed impulse drive unit of the pedal drive system, in accordance with an embodiment of the present invention;

FIG. 8*b* shows a schematic arrangement that illustrates internal components of the impulse drive unit, in accordance with an embodiment of the present invention; and FIGS. 9*a*-9*d* show schematic arrangements that illustrate a propeller locking mechanism, in accordance with an embodiment of the present invention.

Further areas of applicability of the present invention will become apparent from the detailed description provided hereinafter. It should be understood that the detailed description of exemplary embodiments is intended for illustration purposes only and is, therefore, not intended to necessarily limit the scope of the invention.

DETAILED DESCRIPTION

As used in the specification and claims, the singular forms "a", "an" and "the" may also include plural references. For example, the term "an article" may include a plurality of articles. Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present invention. There may be additional components described in the foregoing application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of mechanical components, which constitutes a pedal drive system for a watercraft for propelling the watercraft based on mechanical input provided by a user by means of a pedal arrangement of the pedal driver system. Accordingly, the components have been represented, showing only specific details that are pertinent for an understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

References to "one embodiment", "an embodiment", "another embodiment", "yet another embodiment", "one example", "an example", "another example", "yet another example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

The words "comprising," "having," "containing," and "including," and other forms thereof, are intended to be equivalent in meaning and be open ended in that an item or items following any one of these words is not meant to be an exhaustive listing of such item or items or meant to be limited to only the listed item or items.

Techniques consistent with the present invention provide, among other features, a pedal drive system that transfers rotational motion from a user to a propeller disposed beneath a watercraft such as a kayak or canoe, thus driving the watercraft forward as well as backward. Unless stated otherwise, terms such as "first" and "second" are used to arbitrarily distinguish between the elements such terms describe. Thus, these terms are not necessarily intended to indicate temporal or other prioritization of such elements. While various exemplary embodiments of the disclosed system and method have been described above it should be understood that they have been presented for purposes of example only, not limitations. It is not exhaustive and does not limit the invention to the precise form disclosed. Modifications and variations are possible in light of the above teachings or may be acquired from practicing of the invention, without departing from the breadth or scope.

The pedal drive system will now be described with reference to the accompanying drawings which should be regarded as merely illustrative without restricting the scope and ambit of the disclosure.

Figure 1:
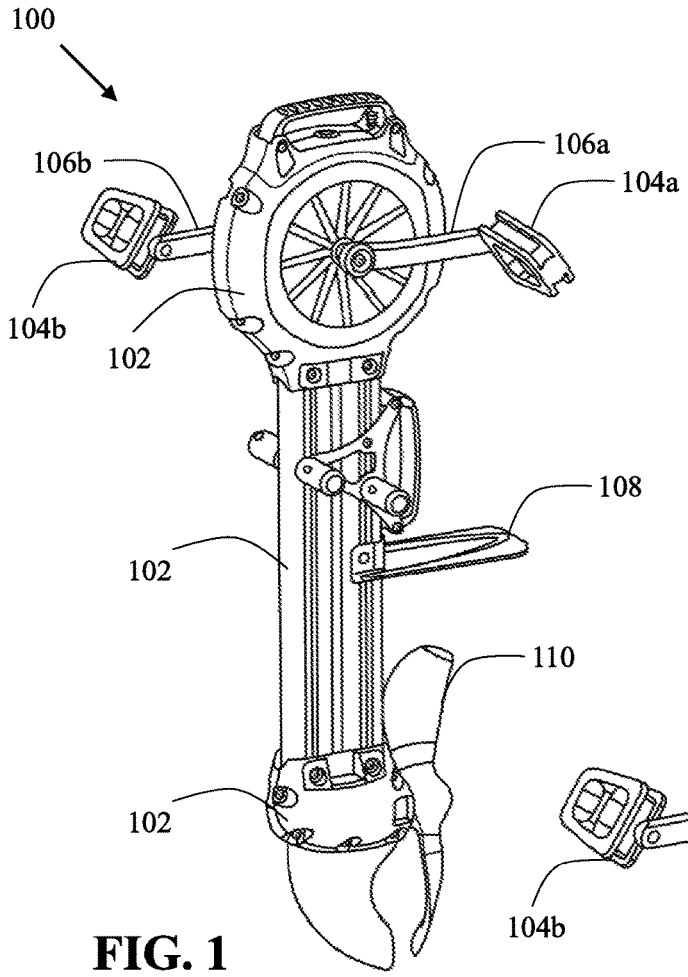
FIG. 1 shows a schematic arrangement that illustrates an enclosed pedal drive system for a watercraft, in accordance with an embodiment of the present invention.

FIG. 1 shows a schematic arrangement 100 that illustrates an enclosed pedal drive system for a watercraft, in accordance with an embodiment of the present invention. The pedal drive system includes an enclosure 102 that houses a pedal mechanism similarly arranged to that of a bicycle. As shown in FIG. 1, the schematic arrangement 100 shows a plurality of pedals such as pedals 104*a* and 104*b*, a plurality of pedal cranks such as pedal cranks 106*a* and 106*b*, and a see-through splash guard 108. The pedal drive system can also include a plurality of foot pegs (not shown).

The pedals 104*a* and 104*b* are levers that are removably fixed to the pedal cranks 106*a* and 106*b*, respectively. The pedals 104*a* and 104*b* are positioned opposite to each other as shown in FIG. 1 and are rotatable about a pedal axis (a horizontal axis). The pedal cranks 106*a* and 106*b* are removably fixed to a shaft that fits tightly with the gear to rotate the pedal cranks 106*a* and 106*b*. The pedal driver system is manually operated by a user when the user provides mechanical input through the rotation of the pedals 104*a* and 104*b*.

Each pedal 104*a* or 104*b* has a pedal platform for supporting the user's foot and a pedal crank 106*a* or 106*b*, respectively. The pedal crank 106*a* is connected at one end to the pedal platform and at the other end to the rotatable wheel (e.g., a pedal gear set). Rotation of the pedal cranks 106*a* and 106*b* due to the mechanical input received from the user's legs causes a corresponding rotation of the pedal gear set. The pedal mechanism transfers the mechanical input into rotation of a propeller 110 of the pedal driver system. A foot peg may also be provided for the user. The user can use the plurality of foot pegs to rest her feet when the user is not pedaling the pedals 104*a* and 104*b*. The see-through splash guard 108 makes taking the pedal drive system out in a easy manner and gives the user a window to see into what lies below. The see-through splash guard 108 also makes it easier for the user to remove the pedal drive system from the watercraft. The pedal drive system is fully removal and easy to carry.

Figure 2:
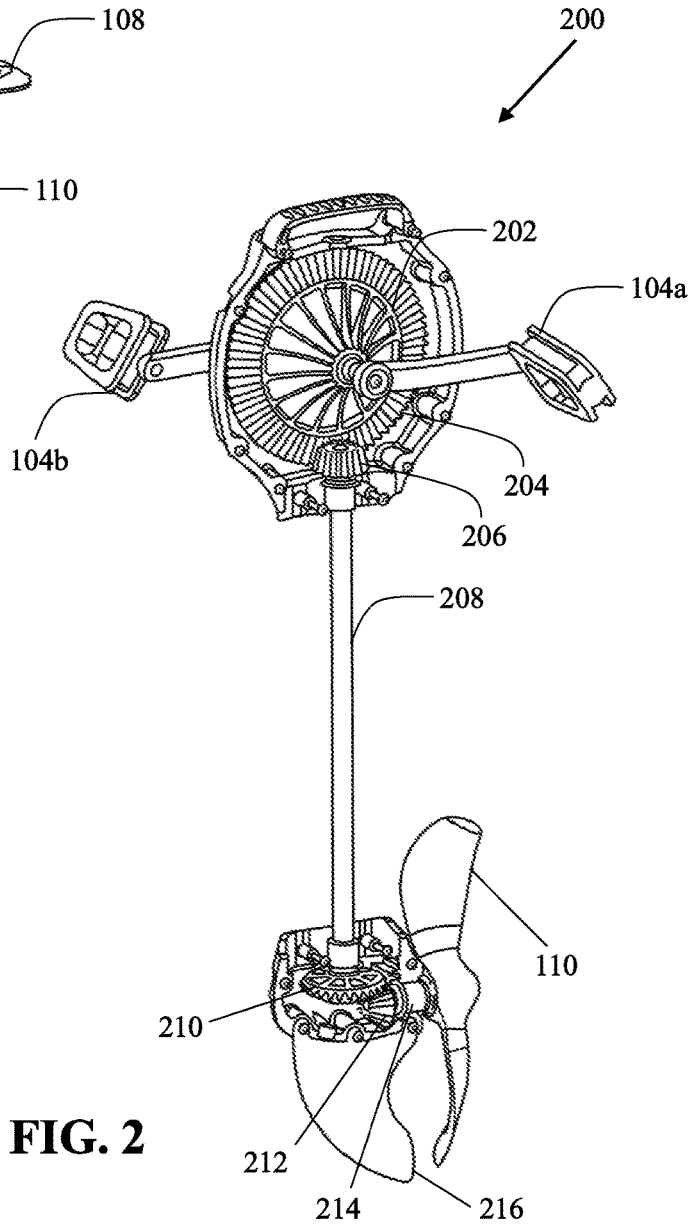
FIG. 2 shows a schematic arrangement that illustrates internal components of the pedal drive system, in accordance with an embodiment of the present invention.

FIG. 2 shows a schematic arrangement 200 that illustrates internal components of the pedal drive system, in accordance with an embodiment of the present invention. The pedal drive system includes the rotatable wheel 202, a first drive gear 204, a second driver gear 206, a first drive shaft 208, a third drive gear 210, a fourth drive gear 212, and a second drive shaft 214. The pedal drive system also includes a pedal-and-sprocket arrangement made up of the pedals 104*a* and 104*b* and the pedal cranks 106*a* and 106*b*. The pedal drive system also includes the propeller 110 and a protective body 216 (such as the one illustrated in the shape of a fin). The protective body 216 is placed in front of the propeller 100 to protect it from damage while in the water.

In an embodiment, the pedal mechanism of the pedal drive system is realized and implemented using the components, as shown in FIG. 2. The pedal mechanism incorporates a channel around the circumference of the rotatable wheel 202. The rotatable wheel 202 rotates when the user operates the pedals 104*a* and 104*b* by providing the mechanical input through her body parts, for example, by pedaling the pedals 104*a* and 104*b* using her feet. The channel retains the first drive gear 204 that extends below the pedal mechanism where the first drive gear 204 makes contact with the second drive gear 206. The first and second drive gears 204 and 206 are positioned in a way in which the second drive gear 206 is perpendicular (90 degrees) to the first driver gear 204, or vice-versa, and the second driver gear 206 rotates from the motion imparted to it by the first drive gear 204.

In an embodiment, the second driver gear 206 is removably attached to the first drive shaft 208 that extends vertically below the hull of the watercraft, and shares an axis of rotation with the second drive gear 206. The opposing end of the first drive shaft 208 retains the third driver gear 210 that also shares an axis of rotation with the second drive gear 206 and the first drive shaft 208. The third drive gear 210 drives the fourth drive gear 212 that is positioned perpendicularly so that an axis of rotation of the fourth drive gear 212 is parallel to the long axis of the watercraft such that the axis is oriented towards the stern of the watercraft. The fourth drive gear 212 drives the second drive shaft 214 which transfers the drive motion (i.e., the rotational motion) to the propeller 110. In an embodiment, the protective body 216 has been placed in front of the propeller 110 to protect it from damage when the watercraft with the pedal drive system is in the water. The protective body 216 may also facilitate steering of the watercraft based on the operation of the pedal drive system by the user.

In operation, the pedal drive system is placed through an opening in the bottom of the watercraft and affixed to the body of the watercraft. The propeller 110 is then attached to the second drive shaft 214. When the user operates the pedal mechanism, the rotational force is transferred from the drive assembly through the drive gears 204, 206, 210, and 212 to the drive shafts 208 and 214 that rotates the propeller 110, thus driving the watercraft forward as well as backward.

Figure 3:
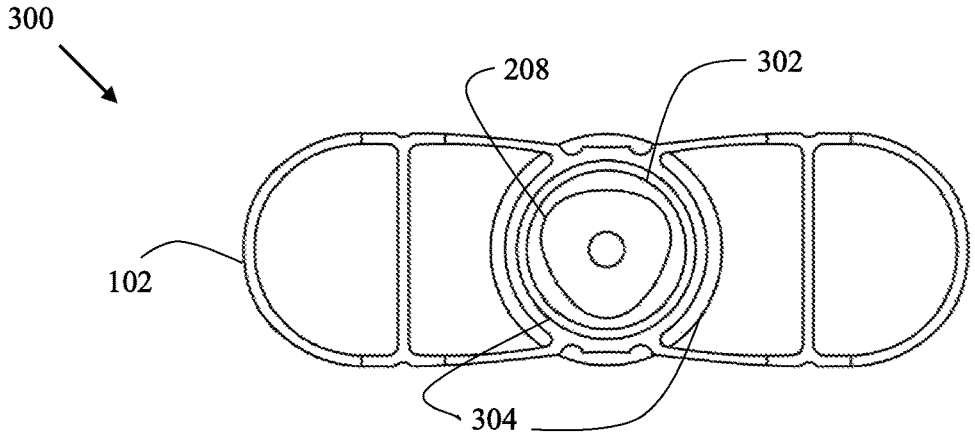
FIG. 3 shows a schematic arrangement that illustrates a top view of a tri-lobe drive shaft of the pedal drive system, in accordance with an embodiment of the present invention.
Figure 4:
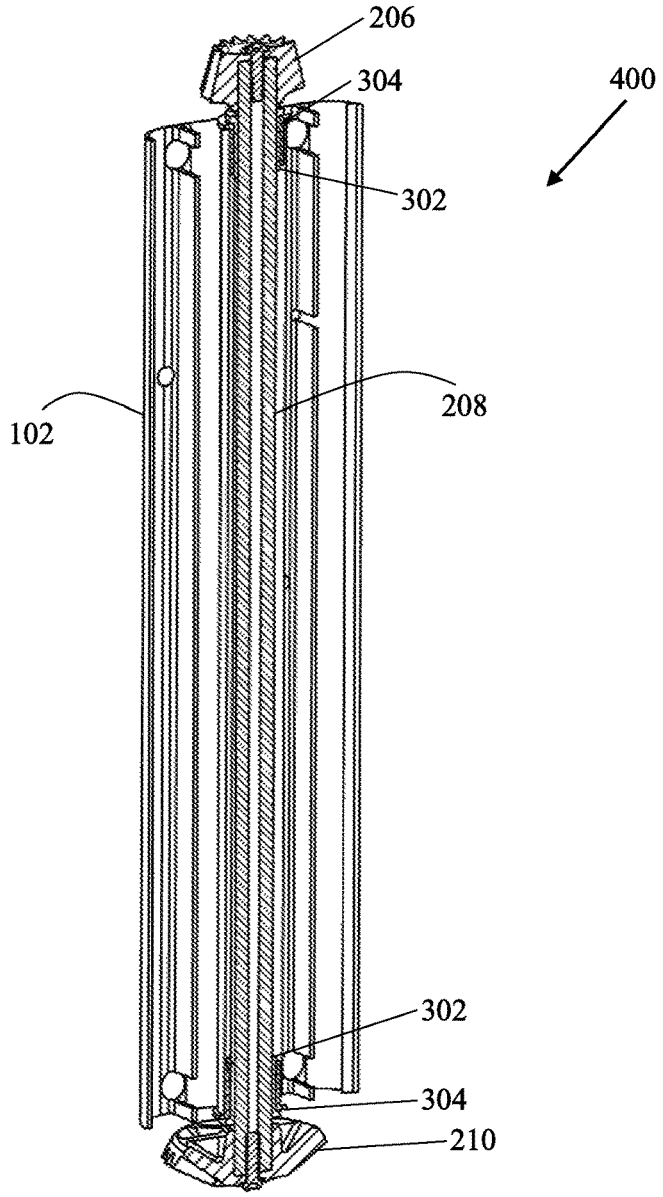
FIG. 4 shows a schematic arrangement that illustrates a side view of the tri-lobe drive shaft, in accordance with an embodiment of the present invention.

FIG. 3 shows a schematic arrangement 300 that illustrates a top view of a tri-lobe drive shaft of the pedal drive system and FIG. 4 shows a schematic arrangement 400 that illustrates a side view of the tri-lobe drive shaft, in accordance with an embodiment of the present invention. The tri-lobe drive shaft is the first drive shaft 208 of the pedal drive system.

In an embodiment, each of component interfaces, where the drive force is transferred from a metal component to a plastic component, has been designed to incorporate the tri-lobe drive shaft 208. The tri-lobe drive shaft 208 has been designed and developed to increase the surface area of contact between the two components, in order to increase the strength of the interfaces. In a traditional attachment, the transfer of power from a metal drive shaft to a plastic drive gear generally requires a much larger gear assembly to resist failure. With a tri-lobe interface facilitated by the tri-lobe drive shaft, the present invention facilitates a much smaller gear assembly while increasing the strength of each joint across each component interface.

In order to incorporate standard round bearings, a tri-lobe spacer 302 has been designed and developed to interface between each shaft and bearing, such as between the tri-lobe drive shaft 208 and the bearing component 304. This tri-lobe bearing interface 302 incorporates a shaped metal sleeve that bolts to the tri-lobe drive shaft 208 in a position between the tri-lobe drive shaft 208 and the bearing component 304. The outer face of the tri-lobe spacer 302 is round so as to provide a proper fit to standard bearings.

The tri-lobe drive shaft 208 shape is profiled in a triangular pattern with constant radius corners and constant convex radius sides. This shape provides strong rotational power transfer (axially) by increasing the contact surface without the incorporation of holes or sharp corners. The tri-lobe drive shaft 208 is used at all connection points or joints within the power transfer assembly of the pedal drive system. For example, tri-lobe drive shafts (similar to the tri-lobe drive shaft 208) are used with a pedal axle shaft to an upper drive gear (e.g., the first drive gear 204), an upper second gear (e.g., the second drive gear 206) to a main drive shaft (e.g., the first drive shaft 208), a lower third gear (e.g., the third drive gear 210) to the main drive shaft, a lower fourth gear (e.g., the fourth drive gear 212) to a propeller drive shaft (e.g., the second drive shaft 214), the propeller drive shaft to the propeller 110, or the like. Also, in an embodiment, the pedal drive can be made longer or shorter by changing or modifying a plurality of parts that go into the center of the pedal drive. For example, the parts, such as the enclosure 102 and the tri-lobe drive shaft 208, may be changed or modified as per the application requirement to facilitate longer or shorter pedal drive. In other way round, the enclosure 102 and the tri-lobe drive shaft 208 may be made longer or shorter that allows to change the overall length of the pedal drive.

In an embodiment, the tri-lobe spacer 302 is used at all bearing locations in lower drive assembly, for example, the main drive shaft to main extrusion housing upper bearing, the main drive shaft to main extrusion housing lower bearing, the propeller drive shaft to lower housing both bearings, or the like.

Figure 5:
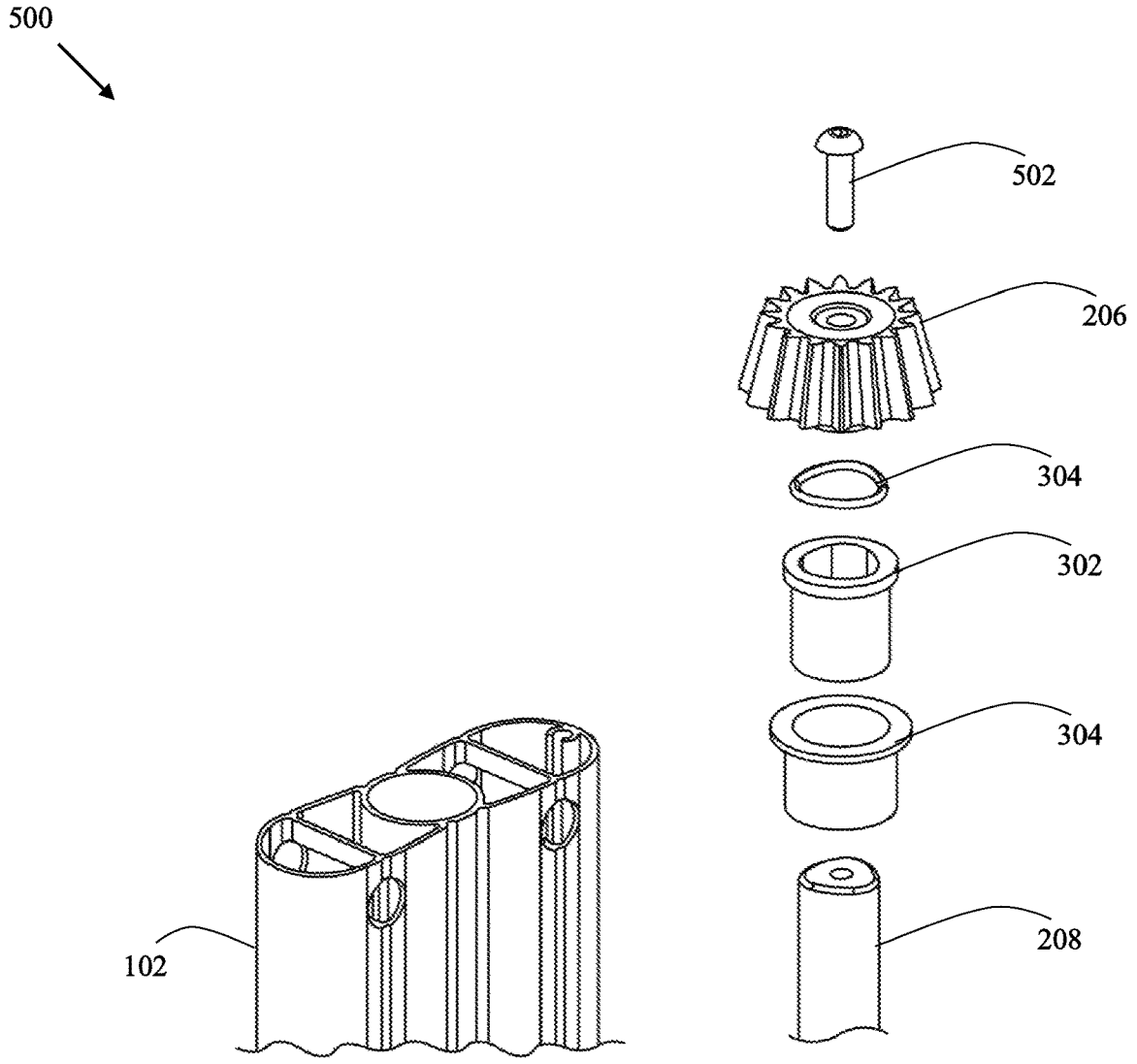
FIG. 5 shows a schematic arrangement that illustrates an expanded view of the tri-lobe drive shaft, in accordance with an embodiment of the present invention.
Figure 6:
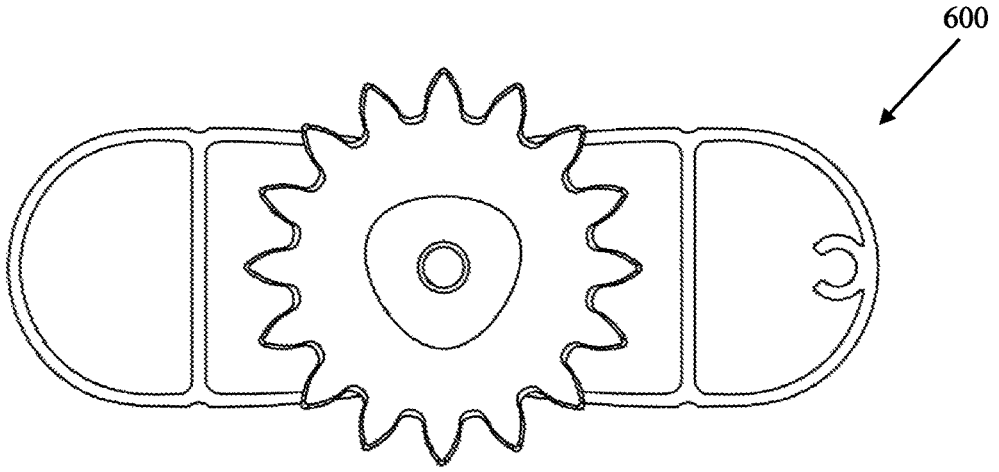
FIG. 6 shows a schematic arrangement that illustrates a top view of the tri-lobe drive shaft with a gear fixed on its top, in accordance with an embodiment of the present invention.

FIG. 5 shows a schematic arrangement 500 that illustrates an expanded view of the tri-lobe drive shaft, in accordance with an embodiment of the present invention. The schematic arrangement 500 illustrates the enclosure 102 that houses the tri-lobe drive shaft 208. After inserting the tri-lobe drive shaft 208 into the enclosure 102, the tri-lobe spacer 302 is removably fixed around the tri-lobe drive shaft 208. Thereafter, the bearing components 304 are removably fixed around the tri-lobe spacer 302. Further, the second drive gear 206 is removably attached to the tri-lobe drive shaft 208 from the top by means of a screw 502. The tri-lobe drive shaft 208 has been shown in FIG. 6 that shows a schematic arrangement 600 for illustrating a top view of the tri-lobe drive shaft 208 with the second drive gear 206 fixed on its top. In continuation with the ongoing discussion, FIG. 7*a* shows a schematic arrangement 700*a* that illustrates a bottom perspective view of the tri-lobe drive shaft 208 and the second drive gear 206 and FIG. 7*b* shows a schematic arrangement 700*b* that illustrates a top perspective view of the tri-lobe drive shaft 208 and the second drive gear 206.

FIG. 8*a* shows a schematic arrangement 800*a* that illustrates an enclosed impulse drive unit of the pedal drive system and FIG. 8*b* shows a schematic arrangement 800*b* that illustrates internal components of the impulse drive unit, in accordance with an embodiment of the present invention. The pedal drive system is impulse drive powered and has been designed to allow water inside the mechanism. The incorporation of the tri-lobe drive shaft allows the use of plastic drive gears (such as the drive gears 204, 206, 210, and 212), in place of metallic drive gears, and as such the internal components within the drive unit are impervious to water damage. This design detail has four significant advantages to a sealed unit. By removing the added costs associated with incorporating a sealed housing, the impulse drive unit can be designed and manufactured at a significantly reduced cost. By designing all of the components to be impervious to water damage, the long-term reliability of the impulse drive unit is increased. Allowing water to fill the internal space provides added stability in relation to resisting roll and yaw during usage by the user. The added weight of the water within the drive shell dampens roll of the watercraft and improves stability for the user. The user can flush the internal components to allow for maintenance cleaning if required.

In an embodiment, the impulse drive unit incorporates a filtered opening 802 at the lowest point in the assembly to allow water to fill the inner space vertically once the drive unit is installed into the drive position within the watercraft. The filtered opening 802 is designed to incorporate a small filter member that restricts the ingress of foreign material into the drive unit. The filter member is designed to filter the water as it comes into the unit and self-clean as the water exits the unit. The filter member is also designed to restrict the flow of water into and out of the unit so that once the water level within the unit is at maximum level, its flow is dampened. The filter member is designed to be removable to allow for cleaning or user replacement. A small inlet port is designed into the top of the upper shell housing allowing the unit to be flushed with clean water for periodic maintenance. Water inlet filter is positioned such that the intake port is lowest in the housing as well as protected by the lower fin assembly.

FIGS. 9*a*-9*d* show schematic arrangements 900*a*-900*d* that illustrate a propeller locking mechanism, in accordance with an embodiment of the present invention. The impulse drive unit incorporates a unique propeller locking mechanism to allow the propeller 110 to be locked into a vertical position for drive install and removal. The propeller locking mechanism includes a pin lock mechanism that utilizes a single thin rod 902 that runs internally along the vertical length of the impulse drive unit. The rod 902 may be made up of a plastic material. An upper end of the rod 902 incorporates a push button assembly 904 that is spring loaded against the upper drive shell. This spring assembly forces the rod 902 into the most vertical position possible with the assembly to keep the opposing end from engaging with the propeller drive shaft assembly.

The main body extrusion is designed with a channel to hold and support the pin lock rod 902. The opposing end of the rod 902 is positioned such that it is free of any interference with the propeller drive shaft assembly when in the upper position. When the rod 902 is lowered (depressed from top button), the bottom end of the rod 902 engages with one of two holes 906*a* and 906*b* designed into one of the drive shaft bearing spacers (such as the tri-lobe spacer 302) supporting the propeller drive shaft assembly. These two holes 906*a* and 906*b* are designed into the bearing spacer (such as the tri-lobe spacer 302) such that when engaged the propeller 110 is locked in a vertical position allowing the drive unit to be lifted through the hole 906*a* or 906*b* in the watercraft where the drive is assembled. This mechanism allows the user to orient the propeller 110 for clearance from the operating position.

The pedal drive presented in the present invention is impulse powered drive and is the most affordable and lightest pedal drive. The pedal drive carries like a regular kayak and requires less effort to propel. The pedal drive is light, fully removable, and easy to store. The pedal drive facilitates effortless forward and backward movement. The pedal drive may include variable gear ratio for each drive gear (such as the drive gears 204, 206, 210, and 212), props and power options. The pedal drive is fully user serviceable and does not require oil or complicated maintenance. Each drive gear is water resistant and is made up of one or more plastic materials i.e., the drive gears 204, 206, 210, and 212 are plastic gears. The materials used in the plastic gears are, in general, engineering plastics such as polyacetal (POM) and MC Nylon which is essentially polyamide resin. In addition, U-PE and PEEK can be used. The positive characteristics of the plastic gears include being lightweight, non-rusting, quiet, injection molding enabling low cost and large production, and able to operate without lubrication by mating with metal gears. The pedal drive has see-through splash guard 108 that makes it easier for the user to remove the pedal drive from the watercraft. The see-through splash guard 108 can be used by the user to lineup the propeller with the pedal driver system and the user can pull out the pedal drive system from the watercraft. In an exemplary embodiment of the present invention, the pedal drive has weight of 8.25 pounds, length of 90 cm, height of 23 cm, and thickness of 7 cm, and can easily fit with the watercraft, such as kayak having weight of 66 pounds, length of 10.4 feet, width of 36 inches, and capacity of 470 pounds, without limiting the scope of the present invention. Thus, the pedal drive of the present invention is more effective and efficient than other pedal drives that are known in the art. The pedal drive is the lightest, most affordable, most seaworthy, and versatile drive in the current market.

Although the present invention has been described with respect to the pedal drive system, it should be understood that the proposed pedal drive system can be formed with varying shapes and sizes, and thus the disclosure here should not be considered limited to the exemplary embodiments and processes described herein. The various dimensions may be modified to fit in specific application areas. The pedal drive system of the present invention features a high-performance encased design that is immune to water damage. All of the materials have been designed/chosen because they are tough and will not corrode or degrade in the water. This dramatically reduces wear and tear of the various components of the pedal drive system and provides a high-performance design that is both user serviceable and incredibly versatile for the retailer and end user.

Although particular embodiments of the invention have been described in detail for purposes of illustration, various modifications and enhancements may be made without departing from the spirit and scope of the invention.

What is claimed is:

1. A pedal drive system for a watercraft, the pedal drive system comprising:

a first drive gear and a second drive gear, wherein the first drive gear is perpendicular to the second drive gear and the first drive gear makes contact with the second drive gear for driving the second drive gear based on a mechanical input provided by a user associated with the watercraft;

a first drive shaft removably attached to the second drive gear, wherein the second drive gear drives the first drive shaft;

a third drive gear and a fourth drive gear that are positioned perpendicular to each other, wherein the third drive gear is removably attached to an opposite end of the first drive shaft, wherein the third drive gear drives the fourth drive gear; and a second drive shaft removably attached to the fourth drive gear, wherein the fourth drive gear drives the second drive shaft that transfer rotational motion to a propeller of the pedal drive system, wherein each of the first drive shaft and the second drive shaft corresponds to a tri-lobe drive shaft that is profiled in a triangular pattern with constant radius corners and constant convex radius sides for providing rotational power transfer by increasing contact surface.

2. The pedal drive system of claim 1, further comprising a pedal-and-sprocket arrangement including a plurality of pedals that are mechanically operated by the user to provide the mechanical input.

3. The pedal drive system of claim 2, wherein the second drive gear rotates based on rotational motion transferred by the first drive gear in response to the mechanical input provided by the user.

4. The pedal drive system of claim 1, wherein the first drive shaft extends vertically below hull of the watercraft and shares an axis of rotation with the second drive gear.

5. The pedal drive system of claim 4, wherein the third drive gear shares an axis of rotation with the second drive gear and the first drive shaft.

6. The pedal drive system of claim 5, wherein the third drive gear drives the fourth drive gear that is positioned perpendicularly so that an axis of rotation of the fourth drive gear is parallel to an axis of the watercraft such that the axis is oriented towards a stern of the watercraft.

7. The pedal drive system of claim 1, further comprising a protective body that is placed in front of the propeller to protect it from damage when the watercraft with the pedal drive system is in water.

8. The pedal drive system of claim 1, wherein the tri-lobe drive shaft is incorporated at one or more joints where rotational motion is transferred from one component to another component of the pedal drive system.

9. The pedal drive system of claim 1, wherein the tri-lobe drive shaft includes a tri-lobe spacer to interface between each shaft and bearing, wherein an outer face of the tri-lobe spacer is round so as to provide a proper fit to standard bearings.

10. The pedal drive system of claim 1, further comprising an Impulse drive unit that allows water Inside a propelling mechanism.

11. The pedal drive system of claim 10, wherein the impulse drive unit incorporates an opening to allow water to fill an inner space vertically once the drive unit is installed into a drive position within the watercraft.

12. The pedal drive system of claim 11, wherein the opening incorporates a filter member that restricts ingress of foreign material into the drive unit, wherein the filter member restricts the flow of water into and out of the drive unit so that once the water level within the drive unit is at maximum level, it's flow is dampened.

13. The pedal drive system of claim 1, further comprising a propeller locking mechanism that allows the propeller to be locked into a vertical position for drive install and removal.

14. The pedal drive system of claim 13, wherein the propeller locking mechanism includes a pin lock mechanism that utilizes a single rod that runs internally along a vertical length of an impulse drive unit.

15. The pedal drive system of claim 14, wherein an upper end of the rod incorporates a push button assembly that is spring loaded against an upper drive shell, wherein the spring assembly forces the rod into the most vertical position possible to keep an opposing end from engaging with a propeller drive shaft assembly.

16. The pedal drive system of claim 1, further comprising a see-through splash guard that can be used by the user to lineup the propeller with the pedal driver system and the user can pull out the pedal drive system from the watercraft.

17. The pedal drive system of claim 1, wherein the first, second, third, and fourth drive gears are made up of one or more plastic materials.

* * * * *